US012402728B2

(12) United States Patent
Luo et al.

(10) Patent No.: US 12,402,728 B2
(45) Date of Patent: Sep. 2, 2025

(54) MATTRESS ELEVATION SYSTEM AND METHODS OF MAKING AND USING THE SAME

(71) Applicants: Xinyue Luo, Wake Forest, NC (US); Joey Lynn Rito, Clayton, NC (US)

(72) Inventors: Xinyue Luo, Wake Forest, NC (US); Joey Lynn Rito, Clayton, NC (US)

( * ) Notice: Subject to any disclaimer, the term of this patent is extended or adjusted under 35 U.S.C. 154(b) by 316 days.

(21) Appl. No.: 18/096,183

(22) Filed: Jan. 12, 2023

(65) Prior Publication Data

US 2024/0237829 A1 Jul. 18, 2024

(51) Int. Cl.
*A47C 19/04* (2006.01)

(52) U.S. Cl.
CPC ..... *A47C 19/045* (2013.01)

(58) Field of Classification Search
CPC ..... A47C 19/04; A47C 19/045
USPC ..... 5/11, 412, 615
See application file for complete search history.

(56) References Cited

U.S. PATENT DOCUMENTS 3,895,404 A * 7/1975 Wilson ..... A47G 9/02 5/482
5,035,016 A * 7/1991 Mori ..... A61G 7/05776 5/713
5,313,679 A * 5/1994 Yamaguchi ..... A47C 19/045 5/659
5,343,893 A * 9/1994 Hogan ..... A61H 9/0078 137/625.11
6,202,672 B1 * 3/2001 Ellis ..... A47C 27/082 251/129.05
7,617,553 B1 * 11/2009 Faiola ..... A61G 7/1021 5/652
2003/0101515 A1 * 6/2003 Gordon ..... A47C 27/082 5/659
2003/0226206 A1 * 12/2003 Ben-Levi ..... A61G 7/001 5/615
2004/0133978 A1 * 7/2004 Fairchild ..... A47C 21/06 5/659
2006/0117486 A1 * 6/2006 Clark ..... A47C 21/06 5/659
2009/0083909 A1 * 4/2009 Amsler, Jr. ..... A47C 21/06 5/660
2014/0026318 A1 * 1/2014 Bethel ..... A47C 21/028 5/412
2015/0257542 A1 * 9/2015 Molina ..... A47C 21/028 5/659
2015/0374134 A1 * 12/2015 Bethel ..... A47C 19/045 5/412
2021/0227991 A1 * 7/2021 Frank ..... A47C 27/10

* cited by examiner

*Primary Examiner* — Myles A Throop
(74) *Attorney, Agent, or Firm* — Ashley D. Johnson; Dogwood Patent and Trademark Law

(57) ABSTRACT

The invention is directed to a system that assists a user in lifting one or more corners of a mattress. In this way, removing or inserting the bed sheets on a mattress is performed easier and faster. The system includes a portable air pump for pushing or directing air, and an air distributor that directs air from the pump to a series of inflatable bladders that function to raise and lower a mattress when inflated or deflated. The bladders are positioned between the mattress and a supporting structure of a bed (e.g., box springs). The tubing connects the air pump to the air distributor and the air distributor to each bladder.

17 Claims, 10 Drawing Sheets

MATTRESS ELEVATION SYSTEM AND METHODS OF MAKING AND USING THE SAME

CROSS REFERENCE TO RELATED APPLICATIONS

This application claims priority to U.S. Provisional Patent Application No. 63/297,846 filed Jan. 10, 2022, the entire content of which is hereby incorporated by reference.

TECHNICAL FIELD

The presently disclosed subject matter is generally directed to a system used to lift one or more corners of a mattress. The presently disclosed subject matter also includes methods of making and using the system.

BACKGROUND

Bedding (including sheets, covers, blankets) must be changed or removed periodically for cleaning. To properly change the bedding, the mattress must be manually lifted to remove and properly wrap fitted sheets around and under the corners of the mattress. Depending on its weight and size, lifting a corner of the mattress can prove to be difficult to some individuals. Specifically, mattresses have gradually increased in dimensions and weight over the years, from "full size" to "queen size" to "king size" to "California king." In addition, the thickness of conventional mattresses has increased due to the application of quilting or similar padding on both sides of the mattress, commonly referred to as a "pillow top." While the mattresses increase sleeping comfort for the users, the changing of linens has become significantly more difficult. These difficulties are especially burdensome to people with physical limitations due to pregnancy, back pain, injuries, surgery, advancing age, and the like. Similarly, hotel housekeepers must routinely change the linens on many beds every day (typically over 35 per shift). The stress and strain associated with the repetitive lifting of heavy mattresses eventually can take a toll on the worker (e.g., lifting injuries). It would therefore be beneficial to provide a system that enables one or more corners of a mattress to be lifted, allowing the user to change the bedding easily and efficiently.

SUMMARY

In some embodiments, the presently disclosed subject matter is directed to a system for elevating the corners of a mattress. Specifically, the system comprises an air pump defined by an output. The system also includes an air distributor defined by an input, an interior, and a plurality of outputs. The system comprises tubing operably attached from the air pump output to the air distributor input. The system includes a series of inflatable bladders, each comprising an interior and a fitting positioned on an exterior surface of the bladder, wherein the fitting is in communication with the bladder interior. The system includes a plurality of tubing, each operably attached from an air distributor output to the fitting of a corresponding bladder. Each bladder transitions from a first inflated state when the interior is at least partially filled with air and a second deflated state when the interior is substantially free from air.

In some embodiments, the air pump is portable.

In some embodiments, the air pump is manual.

In some embodiments, the air pump is electrically powered.

In some embodiments, each bladder includes a groove adjacent to a top face of the bladder.

In some embodiments, each bladder comprises a support board positioned at a lower face of the bladder, wherein the support board includes an indentation in a top face of the support board, the indentation sized and shaped to fit the bladder.

In some embodiments, each support board comprises at least one strap that fits into the groove on an associated bladder.

In some embodiments, air exiting the air pump is at a pressure of about 1-10 psi.

In some embodiments, the system includes at least one feedback sensor positioned within at least one bladder.

In some embodiments, the air distributor has 1-10 outlets.

In some embodiments, each bladder comprises a check valve, pressure relief valve, or both.

In some embodiments, each bladder is formed from natural rubber, synthetic rubber, polymeric material, or combinations thereof.

In some embodiments, each bladder has a thickness of about 0.001-0.5 inches in the deflated state.

In some embodiments, each bladder has a thickness of about 2-10 inches in the inflated state.

In some embodiments, the bladder is configured in a doughnut shape, with a circular body and an internal void in the middle of the body.

In some embodiments, the presently disclosed subject matter is directed to a method of lifting one or more corners of a mattress. Specifically, the method comprises positioning an inflatable bladder of the disclosed system between each corner of a mattress and a mattress support. The method includes initiating the air pump to generate the flow of air into the air distributor to exit the distributor via the outlets to at least partially inflate the bladders, whereby the corners of the mattress are raised about 1-3 inches.

In some embodiments, the method includes removing the tubing from the bladders to deflate the bladders, thereby lowering the bladders to the deflated state on demand.

In some embodiments, the presently disclosed subject matter is directed to a method of changing the bedding on a mattress. Specifically, the method comprises positioning an inflatable bladder of the disclosed system between each corner of a mattress and a mattress support. The method includes initiating the air pump to generate the flow of air into the air distributor to exit the distributor via the outlets to inflate the bladders at least partially, whereby the corners of the mattress are raised about 1-3 inches. The method also includes making up the bed while the air bladders are inflated.

DETAILED DESCRIPTION

Figure 1:
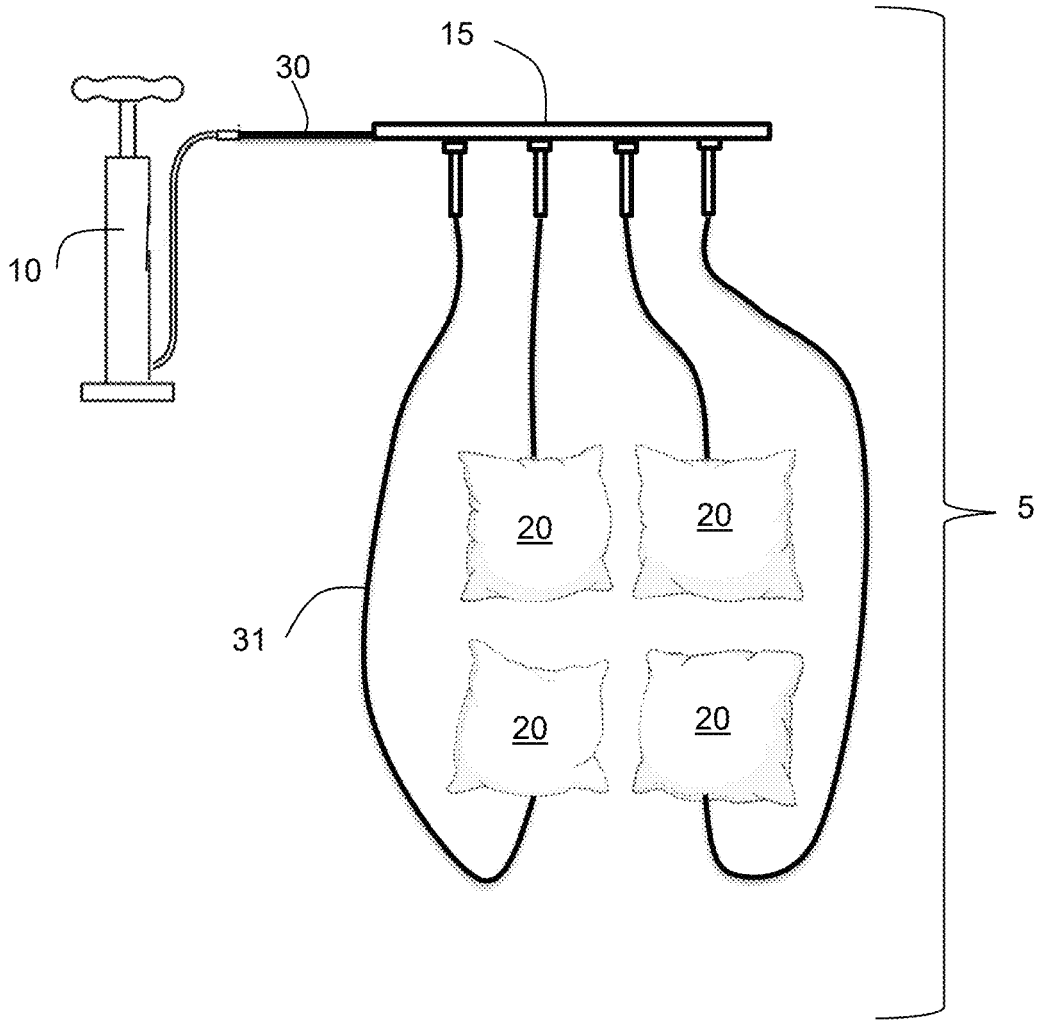
FIG. 1 is a schematic view of a system in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is directed to a device that assists a user in lifting one or more corners of a mattress. In this way, removing or inserting the bed sheets on a mattress is performed easier and faster. FIG. 1 illustrates one embodiment of system 5 comprising portable air pump 10 for pushing or directing air. The device also includes air distributor 15 that directs air from the pump to a series of inflatable bladders 20 that function to raise and lower a mattress when inflated or deflated. The bladders are positioned between the mattress and a supporting structure of a bed (e.g., box springs). A sequence of boards holds each bladder so that it is not moved or adjusted during use. Tubing 30, 31 connects the air pump to the air distributor and the air distributor to each bladder. Advantageously, a user can activate the air pump such that air flows through the distributor and is applied to one or more bladders to raise a corresponding corner or corners of a mattress. In this way, a user can easily and efficiently add or remove bedding without having to manually lift a corner of the mattress. The system can be configured to deflate once the bedding has been changed.

Figure 2A:
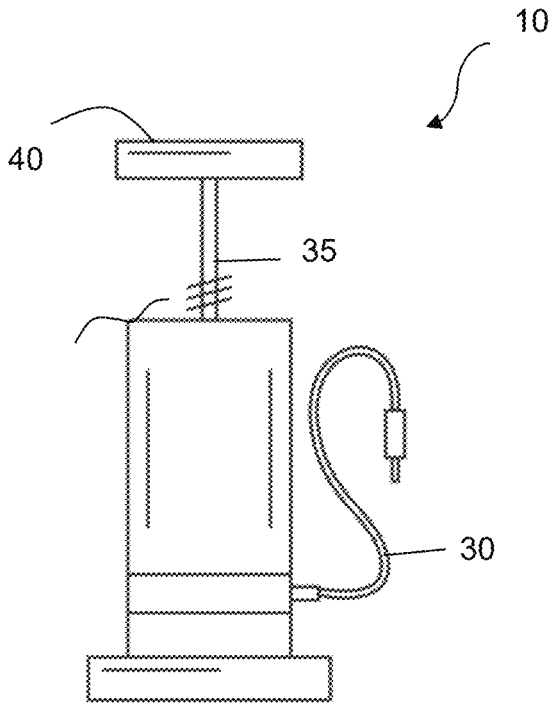
FIG. 2*a* is a front plan view of an air pump in accordance with some embodiments of the presently disclosed subject matter.

As set forth above, the disclosed device includes portable air pump 10 for pushing or directing air into and out of air distributor 15. The term "air pump" generally refers to any apparatus that functions to draw in, compress, and/or exhaust air. Air pump 10 can therefore include any suitable device, such as (but not limited to) one or more pumps, compressors, bellows, and the like. The air pump can include movable arm 35 that drives the flow of air, as shown in FIG. 2*a*. In some embodiments, the air pump can optionally include grip 40 that allows a user to manually activate the pump if desired. When the air is moved via the pump, an area of low pressure is created which fills up with more air. It should be appreciated that air pump 10 can take any form and is not limited to the configuration of FIG. 2*a*. Further, the air pump can be manual (e.g., user operated), digital, remote controlled, and/or automatic.

Air pump 10 can be configured to pump air at any suitable pressure to fill bladders 20. For example, the pump can pump about 1-10 PSI of air for inflating one or more bladders to a substantially uniform pressure. Thus, the pump is capable of providing about 1, 2, 3, 4, 5, 6, 7, 8, 9 or 10 PSI of pressure. However, the presently disclosed subject matter is not limited and the pump can distribute air at any conventional pressure to fill bladders 20.

Figure 2B:
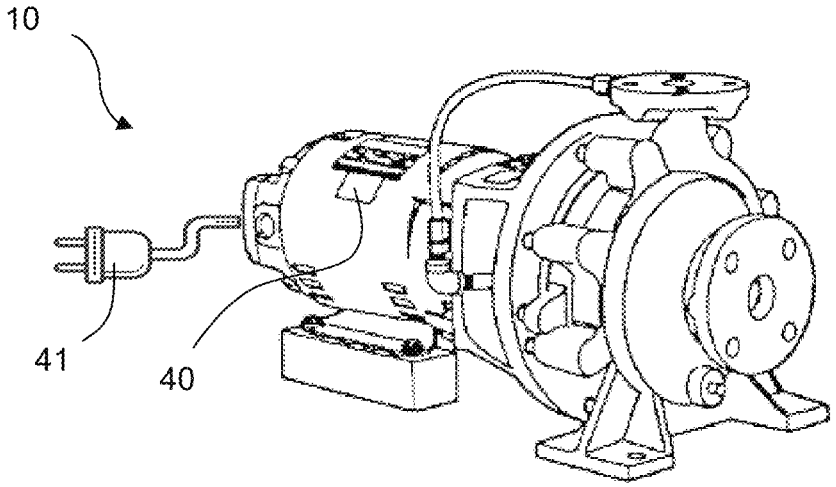
FIG. 2*b* is a perspective view of an air pump in accordance with some embodiments of the presently disclosed subject matter.

In some embodiments, the air pump can include power source 41 engageable with the air pump (e.g., a power cord) to provide power to operate the pump. In these configurations, the air pump can further include switch 40 for activating and deactivating pump 10, as shown in FIG. 2*b*. Alternatively, the air pump can be a cordless battery powered pump. In addition to powered or electric versions, air pump 10 can also be manually operated in some embodiments.

The air pump can further include a control system comprising at least one feedback sensor and an air release timing system. The feedback sensor can be configured as one or more pressure sensors (not shown) located within one or more inflatable bladders 20 or at a valve located at an input channel of the inflatable bladders where tubing 31 connects to the inflatable bladder. The feedback sensor can be configured to sense the internal pressure within bladder 20 and can be in operable communication with the air pump to activate or de-active the flow of air.

As discussed in detail below, air pump 10 can be configured to force air (via the air distributor) to one or more inflatable bladders 20. The air pump can be configured to automatically deliver air to the bladder(s) until each bladder reaches a predetermined amount of air pressure. The air pump can deliver air to each bladder at the same time (e.g., an amount of air is equally added to each bladder at about the same time, about the same rate, and about the same amount). Alternatively, a first bladder can be filled with air to a predetermined level and then the air pump then moves on a fills a second bladder and so forth until all bladders 20 have been filled to a desired level.

When the air pump is activated, air travels from the pump via tubing 30 to air distributor 15. Tubing 30 can be any suitable hollow material used to move air from one location to another. Tubing 30 can be constructed from any conventional material, such as (but not limited to) polymeric material (e.g., nylon, polyethylene, PVC, vinyl), rubber, metal (e.g., aluminum, copper, stainless steel), and the like. In some embodiments, the material used to construct tubing 30 can be flexible, allowing the tubing to be handled and/or moved without breaking. In other embodiments, the tubing is rigid and set in shape.

Figure 3A:
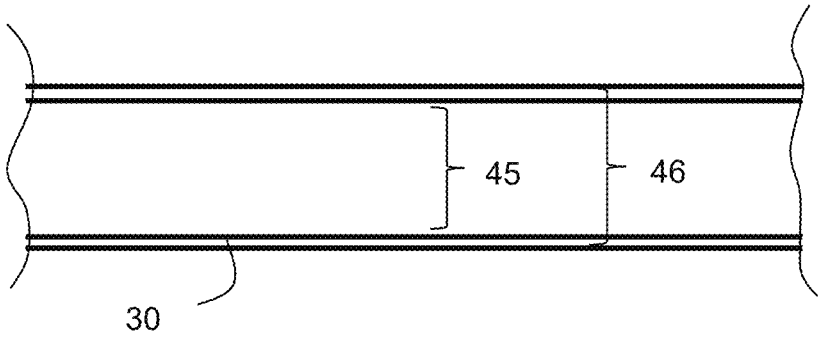
FIG. 3*a* is a fragmentary cross-sectional view of tubing in accordance with some embodiments of the presently disclosed subject matter.

Tubing 30 can have any desired size, such as an inner or outer diameter 45, 46 of about 0.1-1 inch, as shown in FIG. 3*a*. Thus, the tubing can have an inner or outer diameter of about 0.1, 0.2, 0.3, 0.4, 0.5, 0.6, 0.7, 0.8, 0.9 or 1 inch. The term "inner diameter" refers to the diameter of the inner channel of the tubing. The "outer diameter" refers to the diameter of the outer area of the tubing.

Figure 3B:
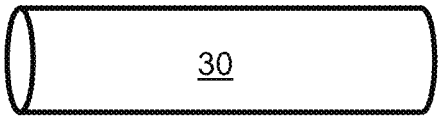
FIG. 3*b* is a perspective view of tubing in accordance with some embodiments of the presently disclosed subject matter.

The tubing can have any cross-sectional shape, such as circular, oval, square, rectangular, triangular, hexagonal, octagonal, and the like. One embodiment of a length of tubing with a circular configuration is shown in FIG. 3*b*.

Figure 3C:
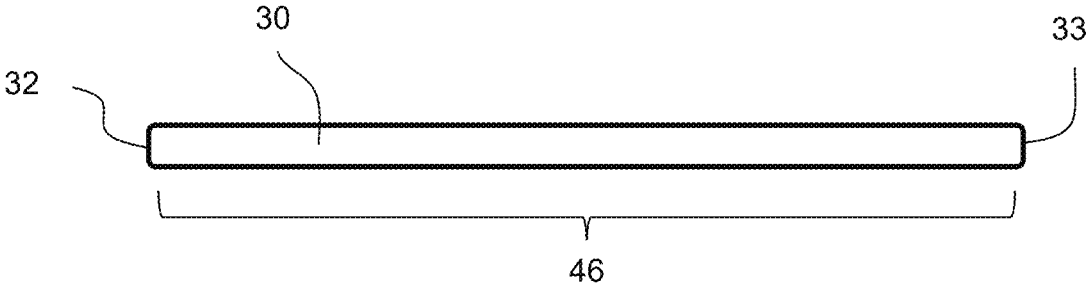
FIG. 3*c* is a front plan view of tubing in accordance with some embodiments of the presently disclosed subject matter.
Figure 3D:
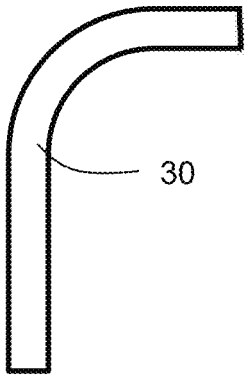
FIG. 3*d* is a front plan view of tubing in accordance with some embodiments of the presently disclosed subject matter.

Tubing 30 can also have any desired length 46, such as about 6 inches to 6 feet, as shown in FIG. 3*c*. The term "length" refers to the distance from first end 32 of the tubing (e.g., the end adjacent to pump 10) to second end 33 of the tubing (e.g., the end adjacent to the air distributor). It should be appreciated that the length of tubing 30 can be adjusted based on how far pump 10 is from the air distributor. In some embodiments, the length of tubing can include bends or other shapes to reach the distributor, as illustrated in FIG. 3*d*.

Tubing 30 can attach to the air pump and distributor using any suitable mechanism, such as (but not limited to) the use of threads, an adaptor, fasteners, valves, and the like.

Figure 4A:
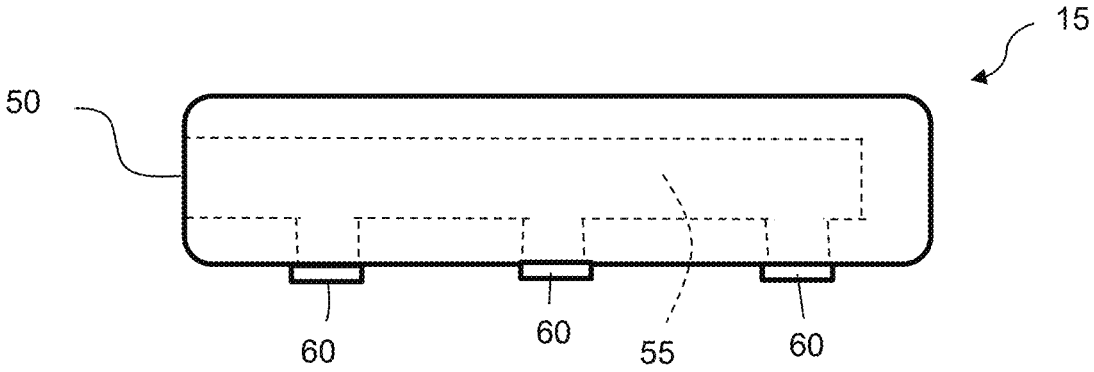
FIG. 4*a* is a front plan view of an air distributor in accordance with some embodiments of the presently disclosed subject matter.
Figure 4B:
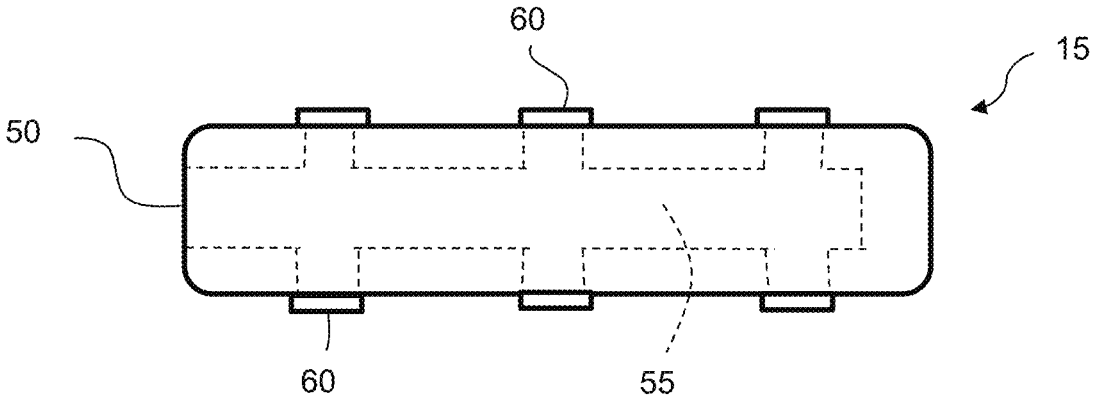
FIG. 4*b* is a front plan view of an air distributor in accordance with some embodiments of the presently disclosed subject matter.

As described above, system 5 also includes air distributor 15. The term "air distributor" refers to any device that dispenses or routes air to one or more outlets. As shown in FIG. 4*a*, air distributor 15 includes input 50 through which air enters interior 55 via tubing 30. Air is then routed through the interior to exit the distributor via a series of outlets 60. The distributor can include any number of outlets, such as about 1-10. Further the outputs can be positioned on a single area of the distributor as shown in FIG. 4*a* or dispersed about the distributor as shown in FIG. 4*b*. The outlets can therefore be positioned on a top, bottom, front, rear, left, and/or right side of the distributor.

Tubing 31 attaches at each outlet 60, allowing air to flow to one or more bladders 20. Tubing 31 can be configured as any hollow material that can move air from a first location to a second location. Tubing 31 can be constructed polymeric material (e.g., nylon, polyethylene, PVC, vinyl), rubber, silicon, metal (e.g., aluminum, copper, stainless steel), and the like. In some embodiments, the material used to construct tubing 31 can be flexible or rigid.

Tubing 31 can have any desired size, such as an inner or outer diameter of about 0.1-1 inch. Further, the tubing can have any desired length, such as about 6 inches to 6 feet.

Tubing 31 can attach to the air distributor and inflators using any suitable mechanism, such as (but not limited to) the use of threads, an adaptor, valves, fasteners, and the like.

Figure 5A:
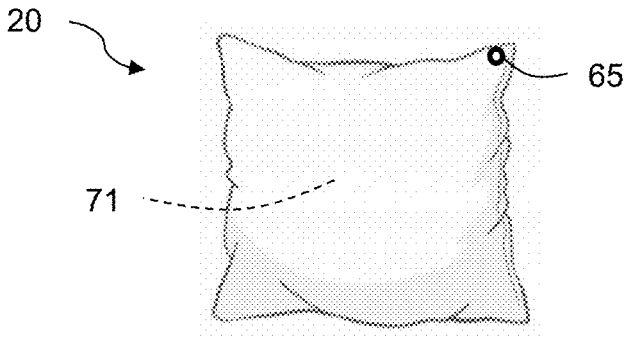
FIG. 5*a* is a perspective view of an air bladder in accordance with some embodiments of the presently disclosed subject matter.

One embodiment of bladder 20 is illustrated in FIG. 5*a*. The term "bladder" refers to any element that can be inflated or deflated on demand. Thus, bladder 20 includes internal cavity 71 that houses a predetermined volume of air. Each bladder includes fitting 65 in fluid communication with internal cavity 71 of the bladder, providing a pathway for the addition or removal of air, thereby inflating and deflating the device.

Each bladder can optionally include one or more check valves or pressure relief valves for maintaining the pressure within an inflatable bladder. For example, a one-way check valve can be positioned at a connection between tubing 31 and the bladder. The check valve can be a releasable valve that opens when the system determines that the inflatable bladder should be deflated (e.g., by user input). A pressure relief valve can also be employed to ensure that the bladder(s) do not exceed a maximum internal pressure.

Figure 5B:
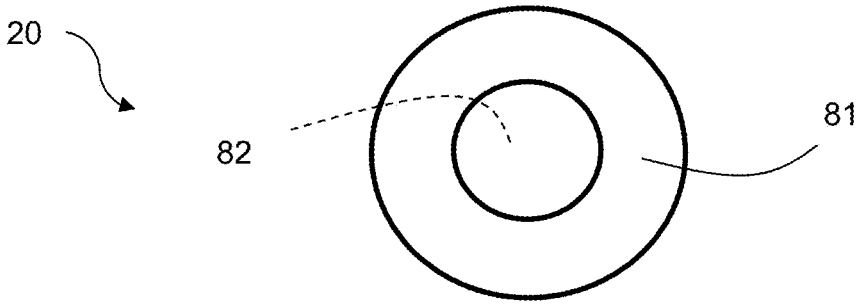
FIG. 5*b* is a top plan view of a bladder with a body and a central void in accordance with some embodiments of the presently disclosed subject matter.

Bladders 20 can have any suitable shape, such as the generally square shape shown in the Figures. However, the bladder can be configured in any desired shape, such as round, oval, rectangular, triangular, doughnut-shaped, T-shaped, and the like. For example, in the embodiment of FIG. 5*b*, the bladder can be doughnut shaped, with body 81 and central void 82. Such a shape can be advantageous because it enables the body to be inflated, while the void allows for easy access by the user to reach any associated valving, grasping the bladder, having less air required to inflate the bladder, and making inserting of the sheets easier because the user can easily access the area of the central void to get under the mattress. However, the shape of each bladder is not limited.

The inflatable bladders can be formed from any material, such as (but not limited to) natural rubber, synthetic rubber, polymeric material, or any similar pliable material selected based on physical characteristics and availability.

Figure 5C:
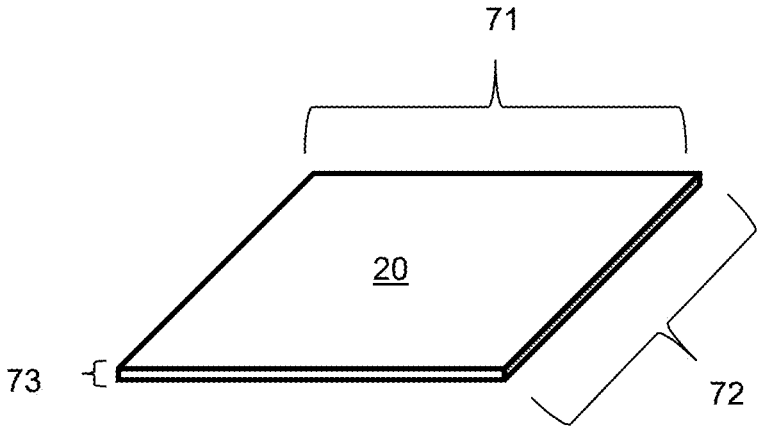
FIG. 5*c* is a perspective view of a bladder in a deflated configuration in accordance with some embodiments of the presently disclosed subject matter.

Each bladder can be sized for use with standard mattress sizes. For example, the bladders can be used with traditional king size mattresses, California king mattresses, queen size mattresses, full size mattresses, or even twin mattresses. FIG. 5*c* illustrates bladder 20 in an uninflated configuration. As shown, the bladder includes length 71 and width 72 of about 3-10 inches. The term "length" refers to the longest horizontal straight-line distance of the bladder. The term "width" refers to the longest vertical distance perpendicular to the length. The bladder also includes thickness 73 of about 0.001-0.5 inches in an uninflated state (e.g., at least/no more than about 0.001, 0.1, 0.2, 0.3, 0.4, or 0.5 inches). The term "uninflated state" refers to the condition of being free of air or substantially free of air (e.g., 90, 91, 92, 93, 94, 95, 96, 97, 98, 99, 99.9 or 100 percent free from air). The term "thickness" refers to the longest straight-line distance from a top face of the bladder to an opposed bottom face.

Figure 5D:
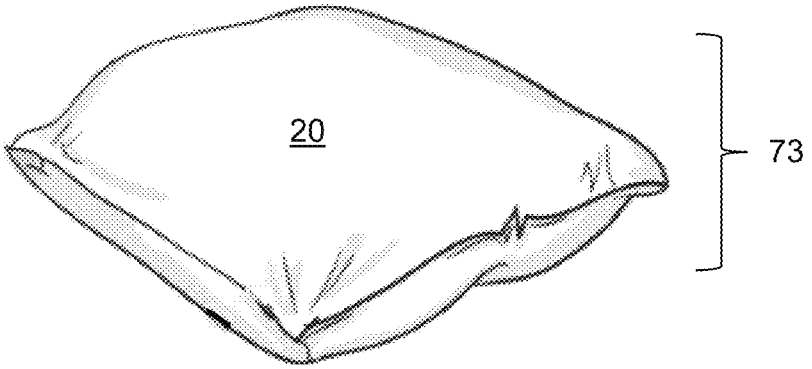
FIG. 5*d* is a perspective view of a bladder in an inflated configuration in accordance with some embodiments of the presently disclosed subject matter.

FIG. 5*d* illustrates one embodiment of bladder 20 in an inflated state (e.g., the condition of being at least partially filled with air). Thickness 73 can be about 2-10 inches. Thus, the inflated thickness of a bladder can be at least about (or no more than about) 2, 3, 4, 5, 6, 7, 8, 9, or 10 inches. The bladder can be about 50-100% filled with air (e.g., at least/no more than about 50, 55, 60, 65, 70, 75, 80, 85, 90, 95, 99, or 100%).

Figure 6A:
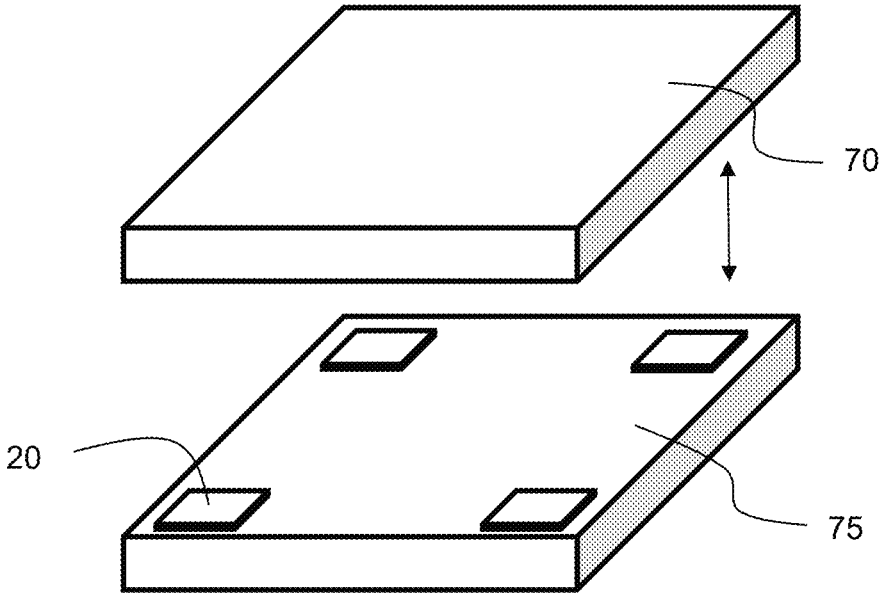
FIG. 6*a* is a perspective view of a series of bladders configured beneath a mattress in accordance with some embodiments of the presently disclosed subject matter.
Figure 6B:
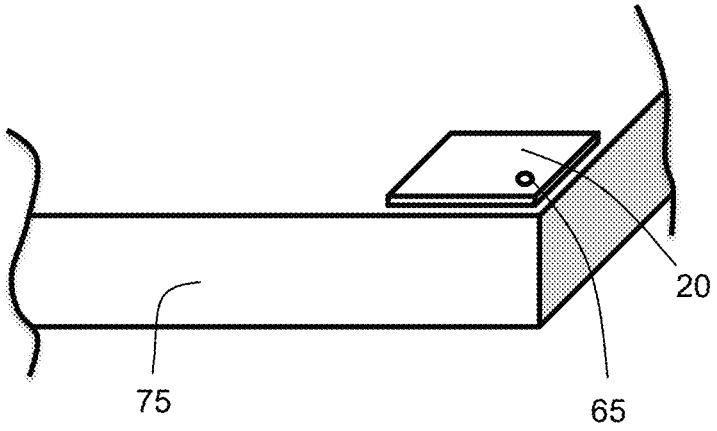
FIG. 6*b* is a fragmentary perspective view of a bladder positioned on a support structure in accordance with some embodiments of the presently disclosed subject matter.

In use, the disclosed system can be used with a conventional bed mattress. Specifically, one or more bladders are positioned beneath a mattress 70 (e.g., between the mattress and box springs or other mattress support 75) at each of the four corners, as shown in FIG. 6*a*. It should be appreciated that the bladders should be positioned at the edges of the mattress so that fitting 65 is accessible to the user. For example, the fitting can be configured pointing outward, closest to the corner portion of the mattress as shown in FIG. 6*b*. Although shown with box springs 75, any support structure can be used, such as a bed frame or the floor or any element upon which mattress 70 rests.

Figure 6C:
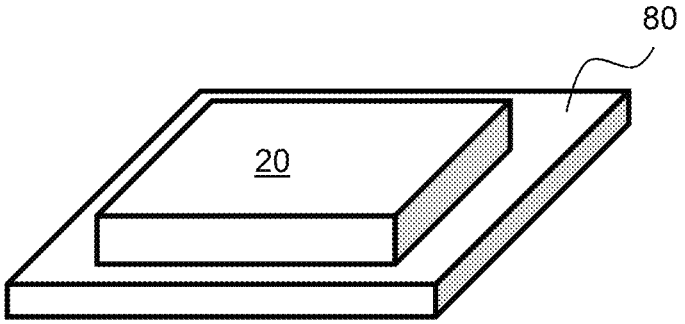
FIG. 6*c* is a perspective view of a bladder configured on a support board in accordance with some embodiments of the presently disclosed subject matter.
Figure 6D:
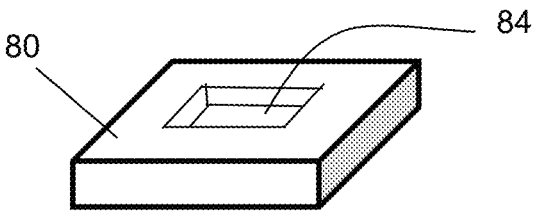
FIG. 6*d* is a perspective view of a support board in accordance with some embodiments of the presently disclosed subject matter.
Figure 6E:
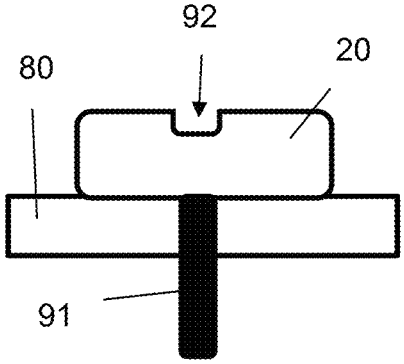
FIGS. 6*e*-6*f* are front plan views of a support board comprising a strap and a bladder in accordance with some embodiments of the presently disclosed subject matter.
Figure 6F:
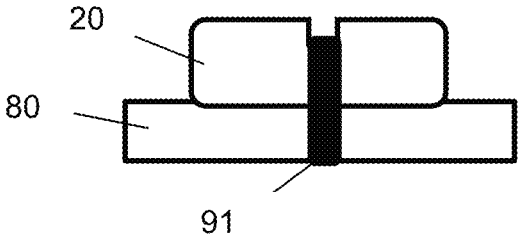

The bladders can be held in place by the weight of mattress 70. In some embodiments, each inflator is held in place by a series of boards 80, as shown in FIG. 6*c*. Each board can include an indentation 84 sized and shaped to accommodate the shape of an associated bladder, as shown in FIG. 6*d*. In some embodiments, the indentation extends all the way through the board. In other embodiments, the indentation only extends partially (e.g., about 10, 15, 20, 25, 30, 35, 40, 45, 50, 55, 60, 65, 70, 75, 80, 85, 90, or 95% through the thickness of the board). In some embodiments, the board can include strap 91 to ensure that the bladder remains in proper position on the board. The bladder can include a corresponding groove 92 that is sized and shaped to fit the strap, as shown in FIGS. 6*e*-6*f*. The strap can be fitted from the board, over the bladder top surface to an opposed face of the board, thereby securing the bladder in position. The strap can be attached via an opposed strap (e.g., using ties VELCRO®, fasteners, etc.) or can be attached to a hook or other securing element on an opposed face of the board.

Figure 6G:
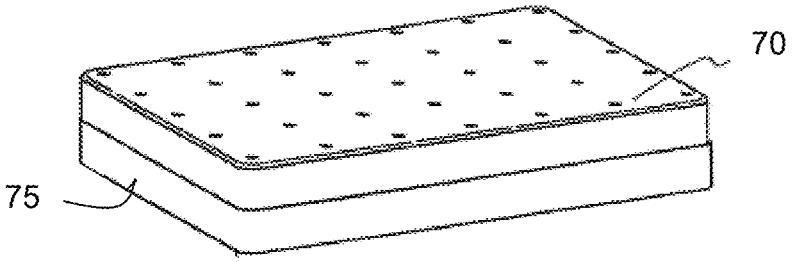
FIG. 6*g* is a perspective view of a series of bladders positioned between a mattress and box springs in accordance with some embodiments of the presently disclosed subject matter.
Figure 6H:
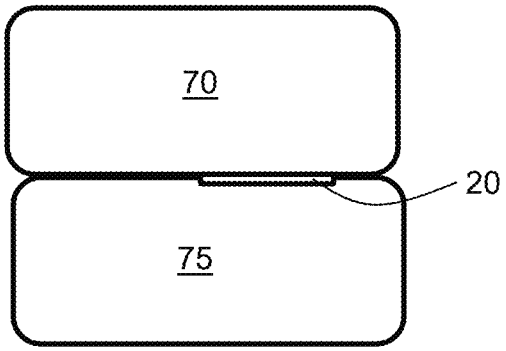
FIG. 6*h* is a cross-sectional view of a bladder positioned between a mattress and a box spring in accordance with some embodiments of the presently disclosed subject matter.

The boards cooperate with the bladders, keeping them from sliding or moving. Alternatively, the bladders can be held in place by VELCRO®, fasteners, clips, and the like. When in a deflated state, the bladders are flat and are not noticeable to the user, as shown in FIGS. 6*g* and 6*h*. When deflated, the weight of the mattress compresses the inflators to a substantially flat orientation such that the user does not feel or notice its presence.

After the bladders have been positioned beneath the mattress, 70, the mattress can be used as desired by the user for sleeping. Because the bladders are so thin in the deflated state, the user does not typically notice that the bladders are present.

When a user desires to the change the bedding on the mattress, they can attach one end of tubing 31 to fitting 65 of one or more bladders 20. The opposing end of the tubing can be connected to air distributor 15. Similarly, the input of the air distributor is in fluid communication with the air pump via tubing 30. As a result, as the air pump is activated, air is moved from the air pump through tubing 30 to the air distributor. The air then flows from one or more outlets 60 via tubing 31 to inflate each bladder to a desired level. In some embodiments, each of the bladders can be inflated simultaneously. In other embodiments, a user can select or more specific bladders for inflation at a desired time (e.g., sequential inflation).

Figure 6I:
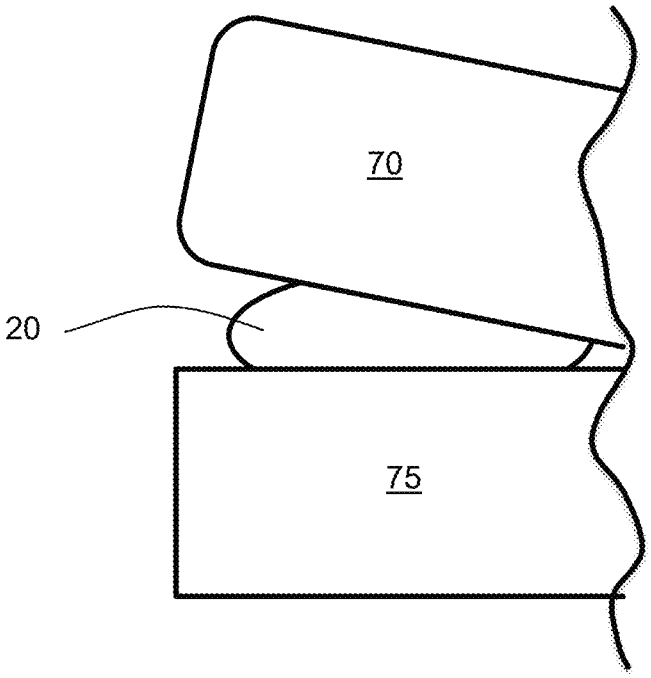
FIG. 6*i* is a fragmentary cross-sectional view of an inflated bladder in accordance with some embodiments of the presently disclosed subject matter.

As a bladder fills with air, the corresponding corner of mattress 70 is elevated vertically, allowing a user to easily remove or add bedding (e.g., sheets) from the mattress, as shown in FIG. 6*i*. In some embodiments, the mattress is lifted about 2-6 inches (e.g., at least/no more than about 1, 2, 3, 4, 5, 6 inches) from a support surface (e.g., box springs). A sheet can therefore be inserted beneath the mattress without a user having to manually lift the mattress. After the user is finished, they can simply disconnect tubing 31 from the bladders. The weight from mattress 70 will exert pressure on the bladders, forcing air through fitting 65 until the bladders are in a flat, deflated configuration.

When not in use, the inflators can remain in position beneath mattress 70 since they are substantially flat and are not noticed by the viewer or the sleeper. The air pump, air distributor and tubing can be easily and conveniently stored until needed.

Figure 7:
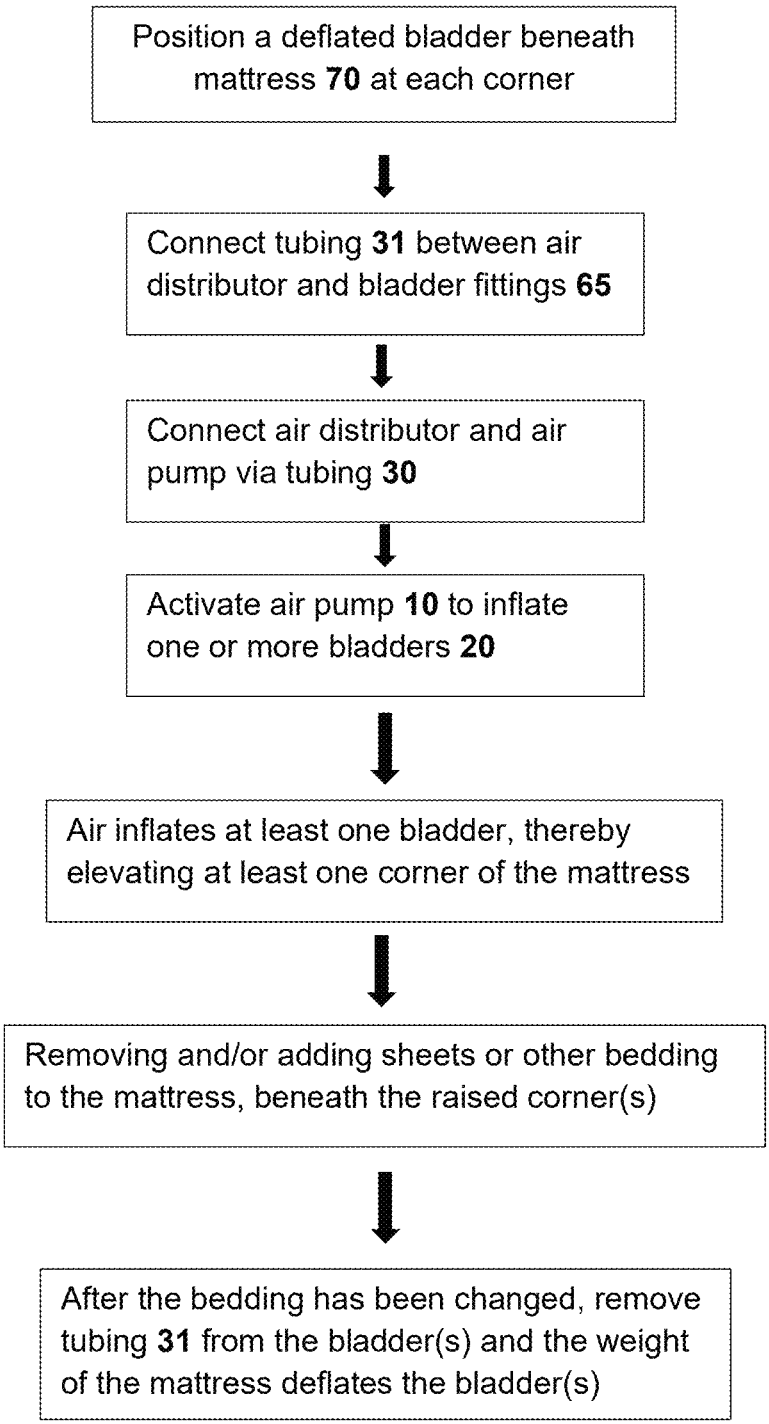
FIG. 7 is a schematic of one method of using the disclosed system to change the bedding on a mattress.

The disclosed system provides many advantages over prior art systems. For example, the system makes changing mattress sheets easier and more streamlined, as set out in FIG. 7. The system can be used to raise one or more corners of the mattress relative to the remainder of the mattress. As a result, a user does not have to manually lift a corner of the mattress to try and add or remove a fitted or top sheet.

The disclosed system can remain positioned beneath a mattress, even when not in use. Due to the substantially flat configuration of the bladders in the deflated state, the bladders are not noticeable to the observer or user.

The system is portable and easily used as needed when it is desired to change a set of sheets or bedding.

The system can also be easily sized to accommodate different sized mattresses, from a twin mattress to a king.

The system can be easily used by a wide variety of users, including the elderly, children, and those with physical limitations (e.g., back or lifting issues).

Small bedrooms with a bed positioned against a wall are traditionally difficult to reach. However, system 5 allows a user to easily access the corners of the mattress to change the bedding as needed or desired.

Exemplary embodiments of the methods and components of the presently disclosed subject matter have been described herein. As noted elsewhere, these embodiments have been described for illustrative purposes only, and are not limiting. Other embodiments are possible and are covered by the presently disclosed subject matter. Such embodiments will be apparent to persons skilled in the relevant art(s) based on the teachings contained herein. Thus, the breadth and scope of the present invention should not be limited by any of the above-described exemplary embodiments but should be defined only in accordance with the following claims and their equivalents.

What is claimed is:

1. A system for elevating the corners of a mattress, the system comprising:

an air pump defined by an output;

an air distributor defined by an input, an interior, and a plurality of outputs;

tubing operably attached from the air pump output to the air distributor input;

a series of inflatable bladders, each comprising an interior and a fitting positioned on an exterior surface of each bladder, wherein each fitting is in communication with each respective bladder interior;

a plurality of tubing, each operably attached from the respective air distributor outputs to the fitting of the corresponding bladder;

wherein each bladder transitions from a first inflated state when the interior is at least partially filled with air and a second deflated state when the interior is substantially free from air;

wherein each bladder includes a groove adjacent to a top face of the bladder, and wherein each bladder comprises a support board positioned at a lower face of the bladder, wherein the support board includes an indentation in a top face of the support board, the indentation sized and shaped to fit the bladder; and wherein each support board comprises at least one strap that fits into the groove on an associated bladder.

2. The system of claim 1, wherein the air pump is portable.

3. The system of claim 1, wherein air exiting the air pump is at a pressure of 1-10 psi.

4. The system of claim 1, further comprising at least one feedback sensor positioned within at least one bladder.

5. The system of claim 1, wherein each bladder comprises a check valve, pressure relief valve, or both.

6. The system of claim 1, wherein the bladder is formed from natural rubber, synthetic rubber, polymeric material, or combinations thereof.

7. The system of claim 1, wherein each bladder has a thickness of 0.001-0.5 inches in the deflated state.

8. The system of claim 1, wherein each bladder has a thickness of 2-10 inches in the inflated state.

9. The system of claim 1, wherein each of the series of inflatable bladders is configured in a doughnut shape, with a circular body and an internal void in the middle of the body.

10. A method of lifting one or more corners of a mattress, the method comprising: positioning an inflatable bladder of a system between each corner of a mattress and a mattress support, the system comprising: an air pump defined by an output; an air distributor defined by an input, an interior, and a plurality of outputs; tubing operably attached from the air pump output to the air distributor input; a series of inflatable bladders, each comprising an interior and a fitting positioned on an exterior surface of the each bladder, wherein the each fitting is in communication with the each respective bladder interior; a plurality of tubing, each operably attached from the respective air distributor outputs to the fitting of the corresponding bladder; wherein each bladder transitions from a first inflated state when the interior is at least partially filled with air and a second deflated state when the interior is substantially free from air; initiating the air pump to generate the flow of air into the air distributor to exit the distributor via the outlets to at least partially inflate the bladders, whereby the corners of the mattress are raised 1-3 inches; wherein each bladder includes a groove adjacent to a top face of the bladder, and wherein each bladder comprises a support board positioned at a lower face of the bladder, wherein the support board includes an indentation in a top face of the support board, the indentation sized and shaped to fit the bladder and wherein each support board comprises at least one strap that fits into the groove on an associated bladder.

11. The method of claim 10, further comprising removing the tubing from the bladders to deflate the bladders, thereby lowering the bladders to the deflated state on demand.

12. The method of claim 10, wherein each bladder has a thickness of 0.001-0.5 inches in the deflated state and a thickness of 2-10 inches in the inflated state.

13. The method of claim 10, wherein air exiting the air pump is at a pressure of 1-10 psi.

14. A method of changing the bedding on a mattress, the method comprising: positioning an inflatable bladder of a system between each corner of a mattress and a mattress support, the system comprising: an air pump defined by an output; an air distributor defined by an input, an interior, and a plurality of outputs; tubing operably attached from the air pump output to the air distributor input; a series of inflatable bladders, each comprising an interior and a fitting positioned on an exterior surface of the each bladder, wherein the each fitting is in communication with the each respective bladder interior; a plurality of tubing, each operably attached from the respective air distributor outputs to the fitting of the corresponding bladder; wherein each bladder transitions from a first inflated state when the interior is at least partially filled with air and a second deflated state when the interior is substantially free from air; initiating the air pump to generate the flow of air into the air distributor to exit the distributor via the outlets to at least partially inflate the bladders, whereby the corners of the mattress are raised 1-3 inches; making up the bed while the air bladders are inflated; wherein each bladder includes a groove adjacent to a top face of the bladder, and wherein each bladder comprises a support board positioned at a lower face of the bladder, wherein the support board includes an indentation in a top face of the support board, the indentation sized and shaped to fit the bladder and wherein each support board comprises at least one strap that fits into the groove on an associated bladder.

15. The method of claim 14, further comprising removing the tubing from the bladders to deflate the bladders, thereby lowering the bladders to the deflated state on demand.

16. The method of claim 14, wherein each bladder has a thickness of 0.001-0.5 inches in the deflated state.

17. The method of claim 14, wherein each bladder has a thickness of 2-10 inches in the inflated state.

* * * * *